US007305775B2

(12) United States Patent
Favret et al.

(10) Patent No.: US 7,305,775 B2
(45) Date of Patent: Dec. 11, 2007

(54) HOUSEHOLD CLOTHES DRYING MACHINE WITH IMPROVED LINT FILTER

(75) Inventors: Ugo Favret, Pordenone (IT); Flavio Noviello, Pordenone (IT)

(73) Assignee: Electrolux Home Products Corporation N.V., Zaventem (BE)

( * ) Notice: Subject to any disclaimer, the term of this patent is extended or adjusted under 35 U.S.C. 154(b) by 3 days.

(21) Appl. No.: 11/344,896

(22) Filed: Feb. 1, 2006

(65) Prior Publication Data

US 2006/0201014 A1 Sep. 14, 2006

(30) Foreign Application Priority Data

Mar. 14, 2005 (EP) ..... 05101960

(51) Int. Cl.
*F26B 21/06* (2006.01)
*F26B 19/00* (2006.01)

(52) U.S. Cl. ..... 34/82; 34/85; 34/140

(58) Field of Classification Search ..... 34/82, 34/85, 604, 607, 134, 138, 140
See application file for complete search history.

(56) References Cited

U.S. PATENT DOCUMENTS 3,320,678 A * 5/1967 Berke ..... 34/82

FOREIGN PATENT DOCUMENTS

| | | | |
|---|---|---|---|
| EP | 0 374 411 | | 6/1990 |
| EP | 489976 | A1 * | 6/1992 |
| EP | 0 512 940 | A1 | 11/1992 |
| EP | 0 648 885 | A1 | 4/1995 |
| EP | 0 816 549 | A2 | 1/1998 |
| GB | 2 350 416 | A | 5/1999 |
| JP | 05-290620 | | 11/1993 |
| JP | 07-236796 | | 9/1995 |
| JP | 07-284595 | | 10/1995 |
| JP | 08-020995 | | 1/1996 |
| JP | 08-121978 | | 5/1996 |
| JP | 08/280996 | | 10/1996 |
| JP | 08-280997 | | 10/1996 |

* cited by examiner

*Primary Examiner*—Jiping Lu
(74) *Attorney, Agent, or Firm*—Pearne & Gordon LLP

(57) ABSTRACT

Clothes drying machine comprising a rotating drum, an exhaust conduit into which flows the air issuing from the outlet aperture of the drum, a lint filter formed in the shape of a sector of a cylindrical surface, which is arranged in said exhaust conduit below said outlet aperture of the drum, with the axis thereof extending substantially parallel to the axis of rotation of the drum, in which there are provided automatic means adapted to ensure cleaning of said filter through a brushing action; said automatic means comprise a brush connected to an end portion of a moving arm, which is hinged, on the other end portion thereof opposite to said brush, on to a rotation pin, said moving arm being slidably linked with a driving pin which is rotating, by means of a respective rotation arm, about a driving spindle that is driven rotatably about its own axis by automatic driving devices.

6 Claims, 6 Drawing Sheets

FIG. 7
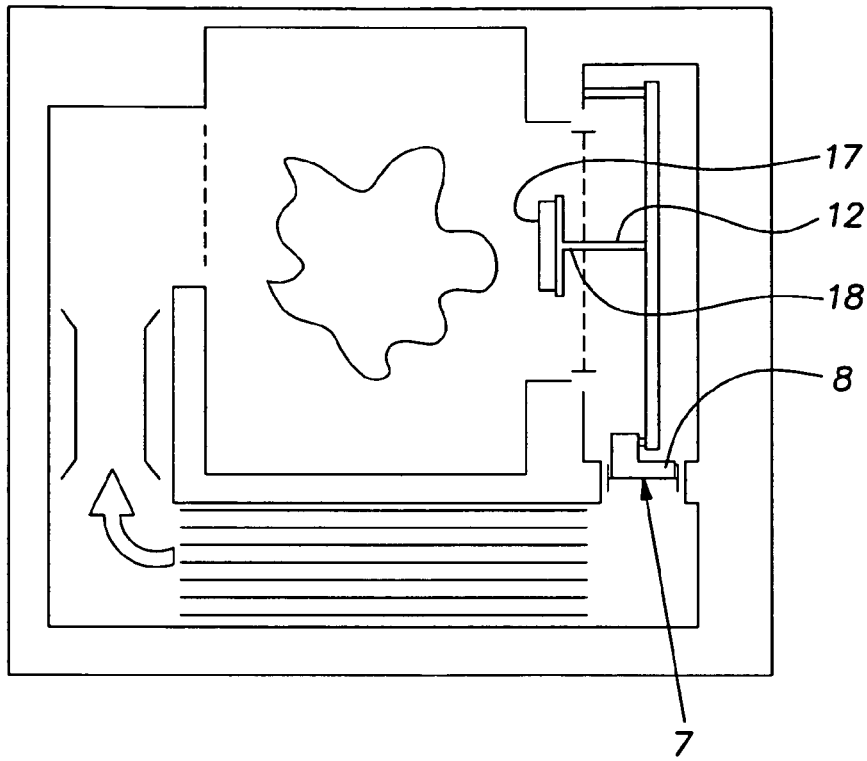
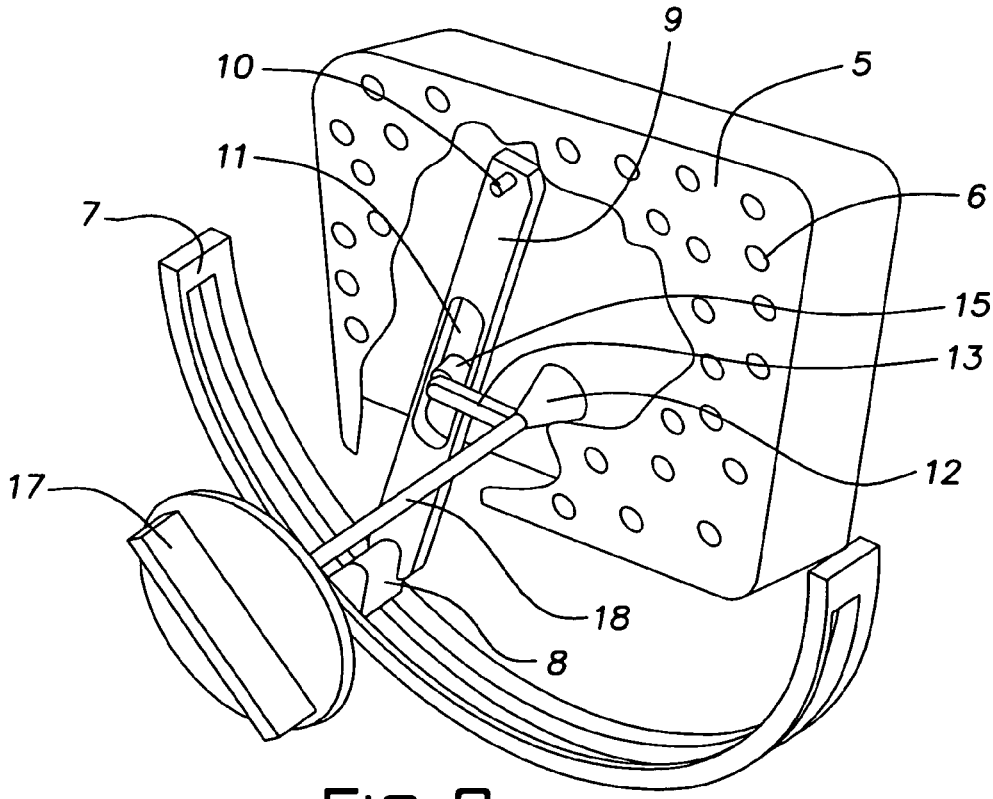
FIG. 8

HOUSEHOLD CLOTHES DRYING MACHINE WITH IMPROVED LINT FILTER

DESCRIPTION

The present invention refers to an improved kind of clothes drying machine, preferably of the type for use in households, which is particularly quiet in its operation.

Largely known in the art are clothes drying machines designed to operate in accordance with different principles, in particular by having the flow of hot air that is blown into and through the drum, where it removes the moisture contained in the clothes being dried, eventually condensed prior to being re-circulated through the drum, or by exhausting this flow of hot moisture-laden air directly outside.

These machines are largely known to be manufactured by installing a ventilation system, usually a blower comprised of a fan and related electric driving motor, which takes in air from the outside ambient and, via an appropriate conduit, blows this air into through the drum holding the drying load.

Inside this conduit there is installed a heating element that, when appropriately energized, heats up the air that, as blown by said fan, passes over it, such that the air eventually entering the drum is sufficiently hot as to cause the moisture contained in the clothes to evaporate.

After having been so blown into the drum, the hot air causes therefore the moisture contained in the clothes to evaporate and, by taking it up, becomes almost saturated therewith. Such hot moisture-laden air is then forced by the same fan to leave, i.e. move out of the drying drum and, from here, it can then be simply exhausted directly into the outside ambient or be suitably conveyed in a continuous flow pattern through a condenser prior to being let again into the drying drum.

It is a largely known fact that, when it leaves the drying drum, the flow of air is caused to pass through one or several filters, which are provided there to retain lint and other small foreign matters and particles that are usually carried away by and borne in the same flow of air passing through the clothes in the drum. In fact, if this lint is allowed to freely circulate along with the flow of air, it would give rise to a number of damages and problems that are well known as such in the art, so that there is no point in having them described here.

However, these lint filters are subject to clogging, and in fact they tend to clog up rather quickly, so that they make it necessary for the user to quite frequently perform a disassembly, cleaning and maintenance chore that, albeit not particularly difficult or laborious, is generally found as something that users do not like very much to carry out, so that they often tend to avoid doing it. Owing to such generally low care and concern by the users, lint filters are quite often left unattended, i.e. without any proper maintenance, so that they soon end up by getting clogged with the unavoidable result that the flow of air therethrough is sensibly slowed down, thereby deteriorating the drying performance of the machine accordingly. In addition, under such conditions the air inside the drum tends to undergo a significant increase in its temperature and this, as anyone skilled in the art is able to readily appreciate, gives rise to both safety problems of a general nature for the machine and a worsening in the handling conditions of the drying load, which is practically "baked" by and tends to yellow due to an excessively high temperature.

In view of doing away with such kind of problems, a variety of solutions have been proposed; the most general one among these solutions consists in providing filters that are easily accessible for cleaning and maintenance, so as this is disclosed in EP 0374411.

In combined clothes washing and drying machines, it is not so unusual to notice that washing or rinsing water is actually re-used to clean the filter and, hence, remove the lint therefrom, as this is for instance described in EP 0816549, or even EP 0648885B1 or JP 08121978.

Another solution of a general kind consists in providing means for measuring a decrease in the flow-rate of the air passing through the filter, as this is caused by the same filter getting gradually clogged up, and comparing the measured flow-rate values with pre-set reference ones so as to determine, based on the outcome of this comparison, a proper cleaning and maintenance schedule for the filter, i.e. the need for the filter to be each time cleaned, as indicated by appropriate warning signals released on the outside of the machine. A solution of this kind is disclosed for instance in EP 0512940.

Disclosed in GB 2350416A is a rather original solution consisting in letting a filter be clogged with an additional mass of lint, which is in this way able to ensure a more effective filtering action. However, this solution has a major, twofold drawback in that it requires the use of very sensitive devices to be able to maintain a calibrated thickness of lint on the filter, while the obstructing effect deriving as far as the flow of hot air passing therethrough is concerned unavoidably leads to a deterioration in the drying performance of the machine.

Known from the Japanese patent application No. 05290620 is a device that is adapted to remove lint depositing on a lint filter in a dryer for fabrics, clothes and the like. In this case, however, the filter is a small-size one that would therefore certainly prove quite inexpedient in the conduit of a drying circuit owing to the air-flow resistance, i.e. pressure loss caused by it. Furthermore, this filter is not readily accessible from the loading opening of the drying drum.

Disclosed in a number of patent publications, such as JP 08280997A2, JP 08280996A2, JP 08280995A2, JP 07284595A2, JP 07236796A2, all of them to RINNAI CORP., are then respective technical solutions aimed at removing mechanically, by means of a scraper, the lint depositing on the filter of a flat and circular type that is arranged in correspondence to the drum access opening, from which the drying air is blown out.

These solutions are fairly effective in themselves. On the other hand, however, they fail to consider the problem connected with the cleaning of the auxiliary filter that is located in a different position in the form of a recessed cylindrical sector.

In this connection, it should be noticed that, for filtering and retaining lint, the use is generally preferred of two or more separate filters, rather than a single one, since, for a same filtering effectiveness, multiple filters tend to clog less and, furthermore, give rise to a smaller overall pressure loss, as anyone skilled in the art is well aware of.

However, the provision of two or more filters is the cause of additional costs, construction complications and, on top of that, greater maintenance and cleaning requirements.

Basically, in all cases described in the above-cited patent publications to RINNAI CORP. what is obtained is a mechanical and automatic cleaning of just a single one of the two filters, while no solution is contemplated in view of not only eliminating one of the two filters, which clothes drying machines are usually provided with, but also doing this by maintaining the overall filtering performance unaltered.

It would therefore be desirable, and it is actually a main object of the present invention, to provide a clothes drying machine, either of the condenser-type or the exhaust-type, which is provided with a single filter for the flow of drying air, to be located at the inlet mouth of the drying-air re-circulation conduit, or exhaust conduit as the case may be, wherein this filter is capable of automatically and permanently performing a cleaning action of said single filter, without any need for the user him/herself to carry out any cleaning or maintenance.

As a result, owing to its being cleanable by the effect of such automatic action, i.e. being kept constantly clean in such automatic manner, this filter becomes much more effective, thereby doing away with the need for a further filter to be provided downstream to aid in retaining lint, and thus eliminating the inconveniences and disadvantages generally connected with the provision of such second filter arrangement.

According to the present invention, these aims, along with further ones that will become apparent further on in the following description, are reached in a clothes drying machine incorporating the features and characteristics as recited in the appended claims. Anyway. Features and advantages of the present invention will be more readily and clearly understood from the description that is given below by mere way of non-limiting example with reference to the accompanying drawings, in which:

FIG. 7 is a view of the device of FIG. 3, as embodied with a different construction for a different mode of operation;

FIG. 8 is a perspective view of the sole device and filter assembly of FIG. 7;

Figure 1:
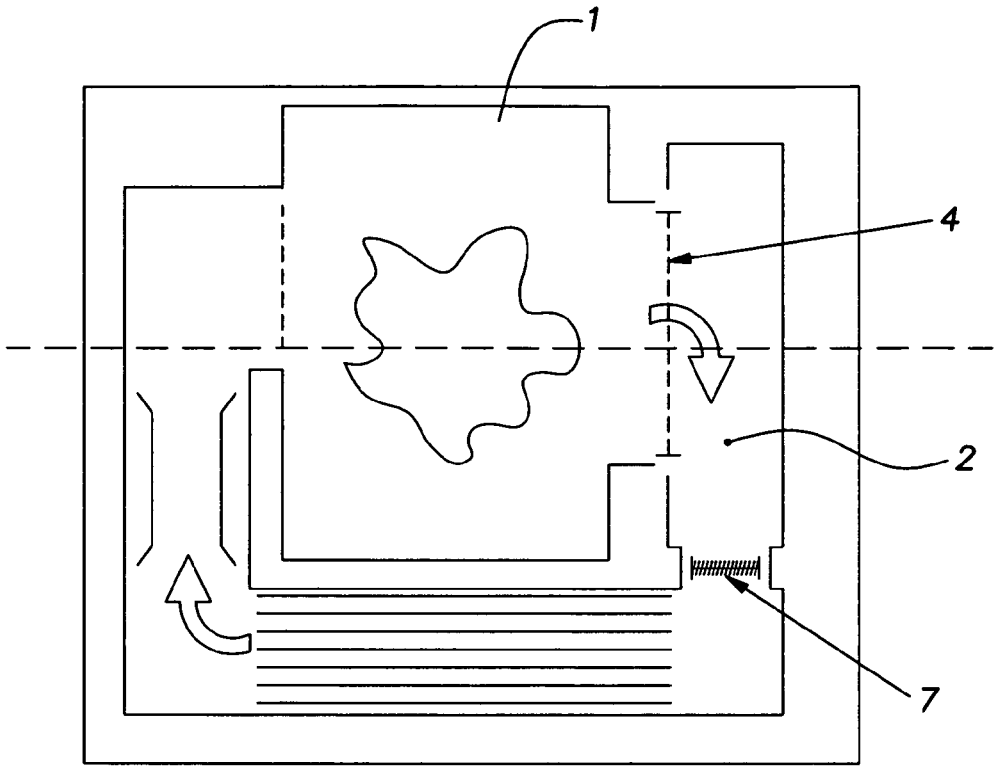
FIG. 1 is a median vertical and cross sectional view (back and forth) of a clothes drying machine provided with a filter adapted to be cleaned by means of a device according to the present invention, in which said filter is however illustrated as not yet provided with said device.

With reference to FIG. 1, in a clothes drying machine according to a preferred embodiment of the present invention there is provided a drum 1 to hold the clothes to be dried, to which there is associated an exhaust conduit 2 for the outflow of the drying air. In condenser-type clothes drying machines, this conduit continues by connecting to a so-called re-circulation conduit 3, which is provided in order to collect the flow of drying air exiting the drum and convey it through an appropriate condenser arrangement and, from this condenser, on again into the drum.

Although a condenser-type clothes drying machine is in all cases illustrated schematically in the Figures, those skilled in the art will of course be readily capable of applying the related teachings to a by the way much simpler exhaust-type clothes drying machine.

From the clothes holding drum, the flow of drying air thus flows into said exhaust conduit 2 by passing through a conventional outlet mouth or opening 4, onto which there is applied—in a manner known as such in the art—a stationary wall 5 that does not shuts or seals said outlet mouth, but—owing to its being provided with a plurality of perforations 6, rather enables the flow of drying air to pass from the interior of the drum into said exhaust conduit 2 and, eventually, said re-circulation conduit 3.

To determine the zone at which said exhaust conduit 2 joins with said re-circulation conduit 3 there is provided a filter 7 adapted to retain lint borne by the flow of drying air passing therethrough. This filter 7 is arranged immediately downstream of said outlet mouth 4 and is—as usual—in the form of a sector of a cylindrical surface, which is much smaller in height than in diameter and forms a reduced arc—with respect to the full possible 360°-extension—about the axis of the cylinder.

Furthermore, the axis of said cylindrical surface of the filter is parallel to the axis of rotation of the drum.

The exhaust conduit 2 collects the flow of drying air from the outside of said stationary wall 5 and conveys it through said filter 7, thereby bringing about the required filtering action.

Figure 2:
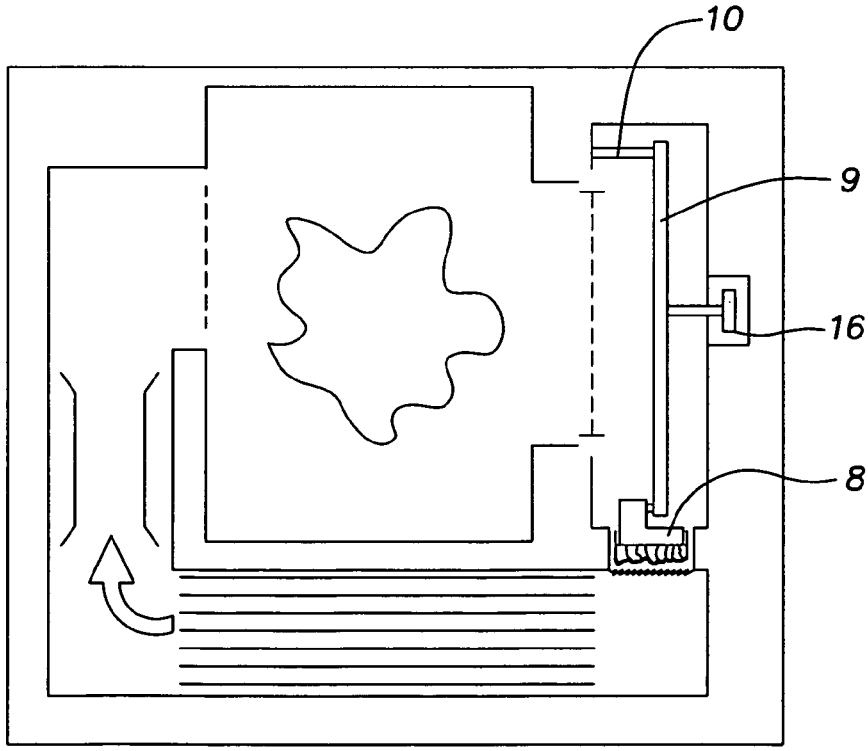
FIG. 2 is a same view as the one appearing in FIG. 1, in which said device is however illustrated in a symbolical manner.
Figure 3:
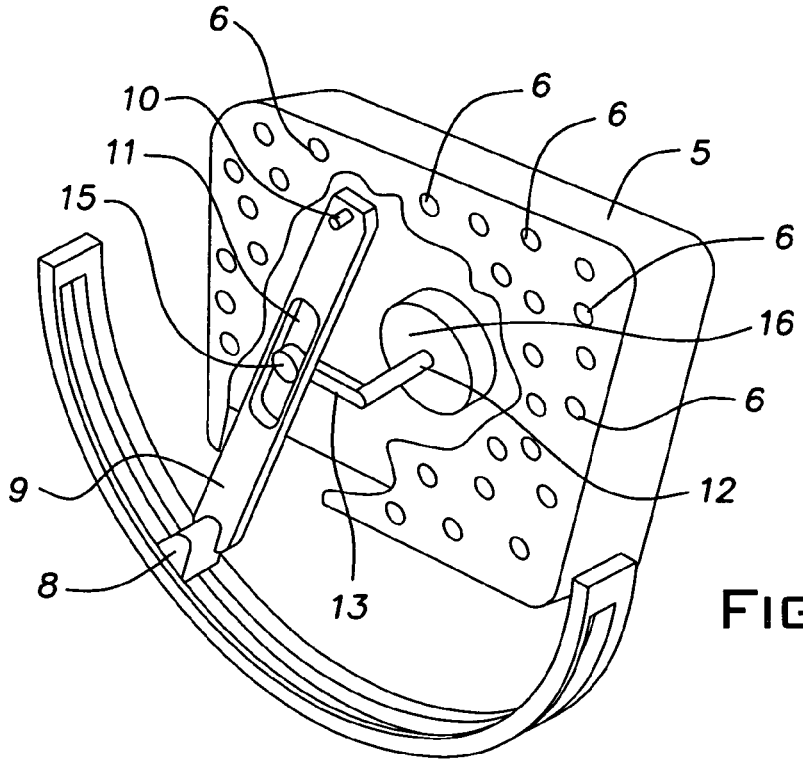
FIG. 3 is a perspective view of the sole device and filter assembly of FIG. 2.
Figure 4:
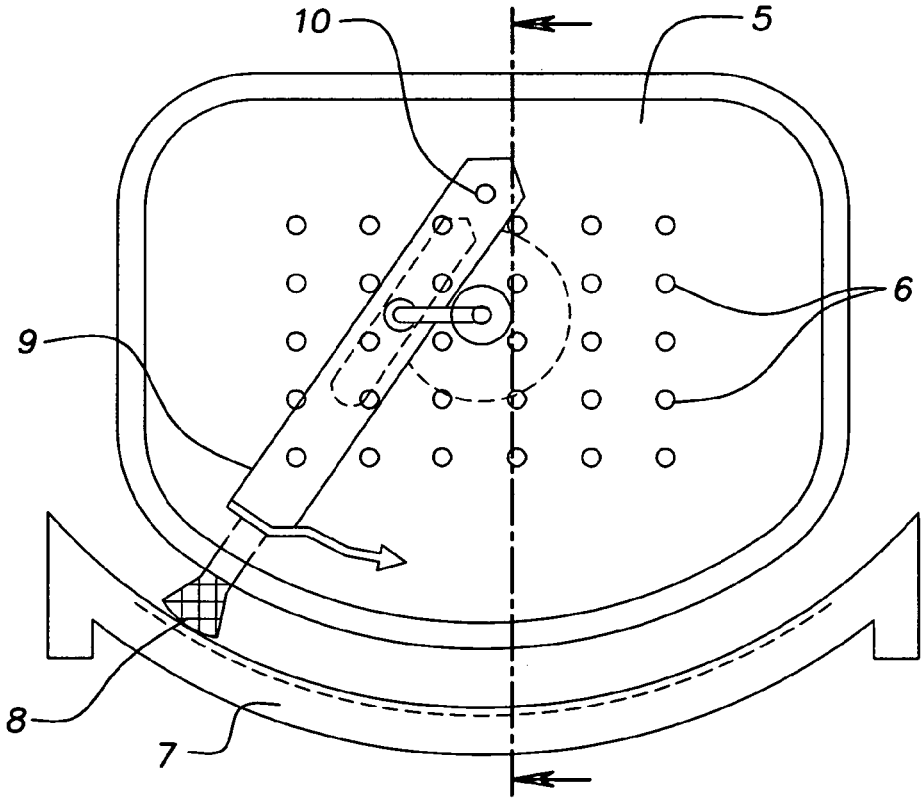
FIG. 4 is a front view of the device of FIG. 3.

According to the present invention, and with particular reference to FIGS. 2 and 3, there is provided a brush 8 that is adapted to wipingly slide upon the surface of said filter, of course on the inflow side thereof, i.e. the side of the filter from which said drying air flows in and, therefore, from above. For this brush to be driven to perform a movement along an arc of a circle corresponding to the cross-sectional contour of the filter, there is provided a moving arm 9 connected with an end portion thereof to said brush 8 and, with the other end portion thereof, to a rotation pin 10 firmly associated to, i.e. being part of the machine.

In the middle portion thereof, said moving arm 9 is provided with an elongated slit 11, and it is capable of oscillating with a swinging motion on a plane in front of the mouth or opening of the drum.

Again as a part of, i.e. firmly associated to the machine there is provided a driving spindle 12, on which there is applied a rotating arm 13 adapted to rotate on a plane that is substantially parallel to the plane of oscillation of said moving arm 9.

Figure 6:
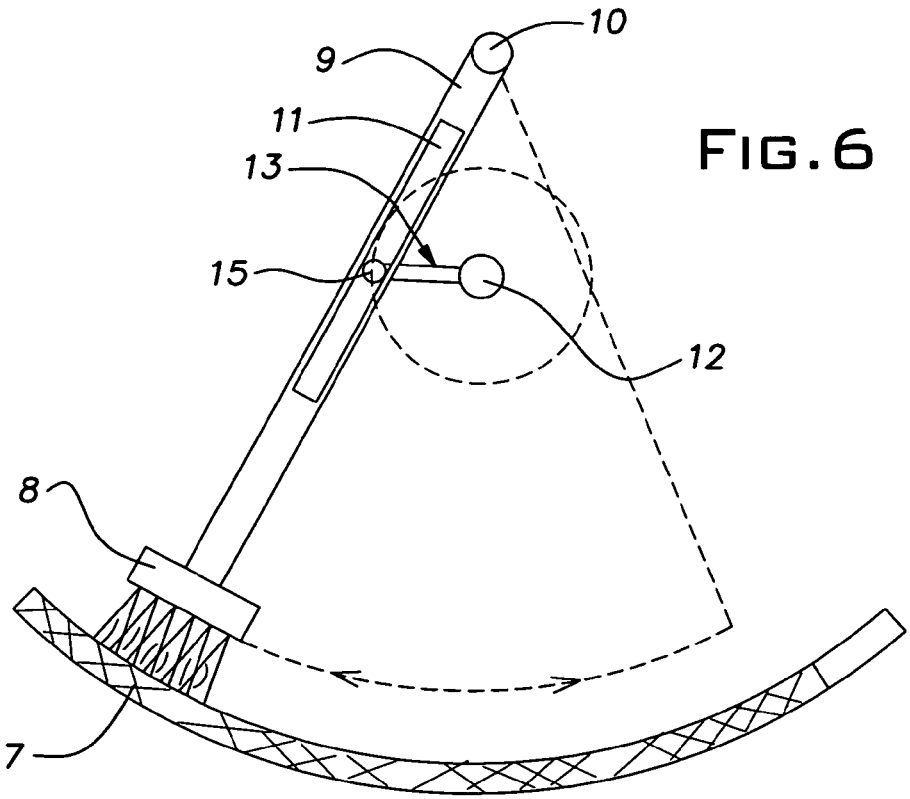
FIGS. 5 and 6 are schematical views illustrating the mode of operation of the device of FIG. 4, which is shown in two distinct operating positions thereof.
Figure 5:
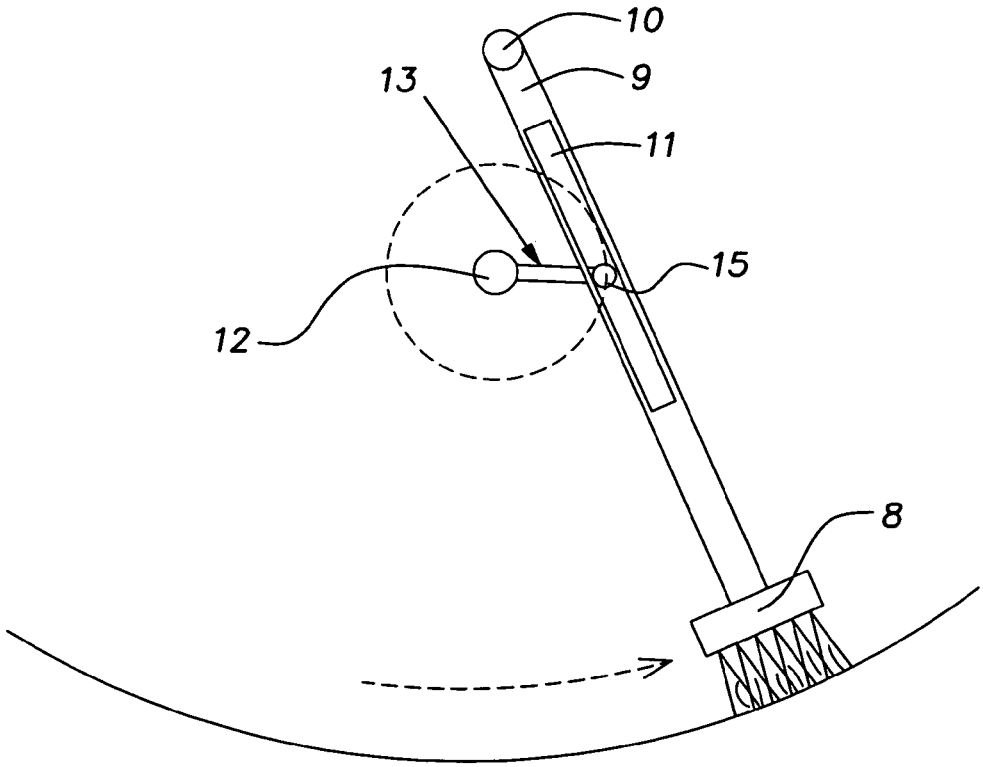

At an end portion of this rotating arm 13 there is attached a driving pin 15, which is so sized as to be able to get inserted in and engage said elongated slit 11. The mutual arrangement and dimensions of the various above-described parts and members are such that, if the driving spindle is caused to rotate, it will drive said rotating arm 13 into performing a circular motion itself. This is transmitted to the driving pin 15, which in turn drives, i.e. causes said elongated slit 11 to displace. The latter will of course drive the moving arm 9 that, owing to its being hinged on to the rotation pin 10, performs a reciprocating swinging, i.e. oscillating motion of the kind typically performed by windshield wipers. Since at the oscillating, i.e. swinging end portion of the moving arm there is provided the above-cited brush 8, it can be readily appreciated that the latter is thereby driven into a reciprocating motion along an arc of a circle, as this is symbolically shown in FIGS. 5 and 6, which illustrate, albeit in a rather simplified manner, two distinct operating positions of the device in two respective moments of its reciprocating motion. By performing this oscillating motion, the brush is therefore able to cover, and regularly wipe, the whole surface of said filter 7, thereby cleaning it from all lint depositing thereonto. In the process, the lint removed in this way is pushed aside and heaped up there for being finally removed with known means.

Two options are contemplated for driving said driving spindle 12, i.e.:

in a first embodiment, there is provided a small electric motor 16, whose shaft coincides with said driving spindle; this solution based on the provision of a dedicated electric motor is advantageous from a functional point of view, since such motor can actually be set and arranged so as to operate in the most desired manner, e.g. at pre-set intervals, in a manner that is independent of the actual drying cycle being carried out; it however implies a corresponding and unavoidable increase in production costs that in certain cases simply cannot be accepted;

the solution adopted in a second embodiment, as this can best be seen in FIGS. 7 and 8, does away with such drawback and makes use of a first driving member 17, in the form of a vane or in any other suitable form allowing this member to be introduced inside the drum, among the clothes to be dried, and be thereby driven rotatably about a connecting rod 18, whose axis of rotation coincides with said driving spindle 12.

Obvious will appear at this point also the fact that, for the sake of an improved functionality of the arrangement, as well as in view of preventing excessive, undesired forces from weighing upon said connecting rod 18, even the latter shall be substantially coincident with the axis of rotation of said drum.

In this way, as the drying load is tumbled inside the rotating drum it will cause said connecting rod and, as a result, said driving spindle to rotate, thereby actuating the afore-described brush driving mechanism.

In an advantageous manner, both moving arm 9 and said driving spindle 12, and said connecting rod 18 with the related first driving member 17, are hinged on to and supported by said stationary wall.

In practice, this enables an oscillating movement to be performed on a same vertical plane and this allows for an obvious simplification in both construction and operation.

This solution, however, might be regarded as being still too complicated and, for the matter, even exaggerated, considering that no need usually exists for the filter to be freed from lint each time that the clothes in the drying drum are turned thereinside.

Figure 9:
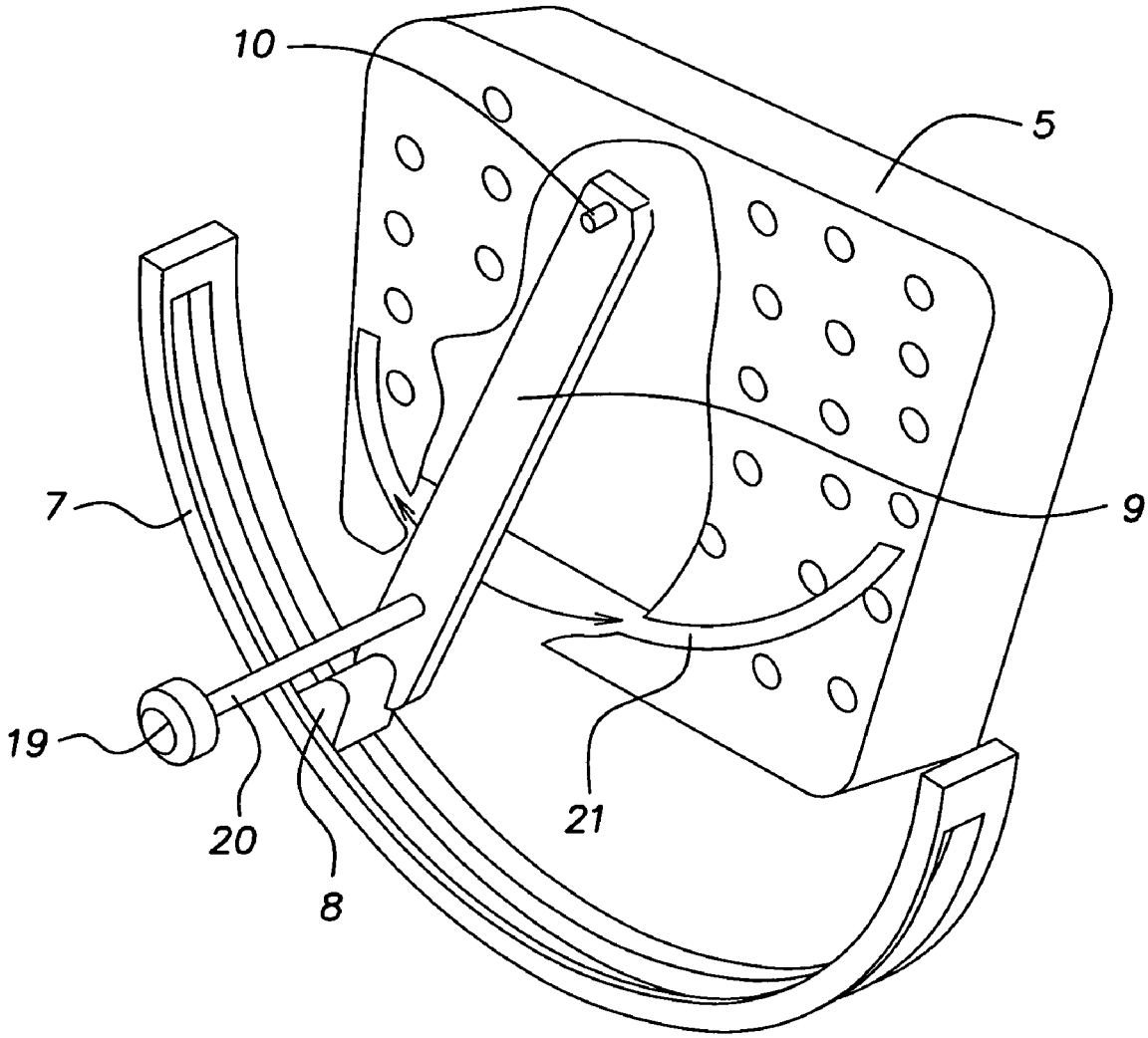
FIG. 9 is a view of the device of FIG. 3, as embodied again with a further different construction for a further different mode of operation.
Figure 10:
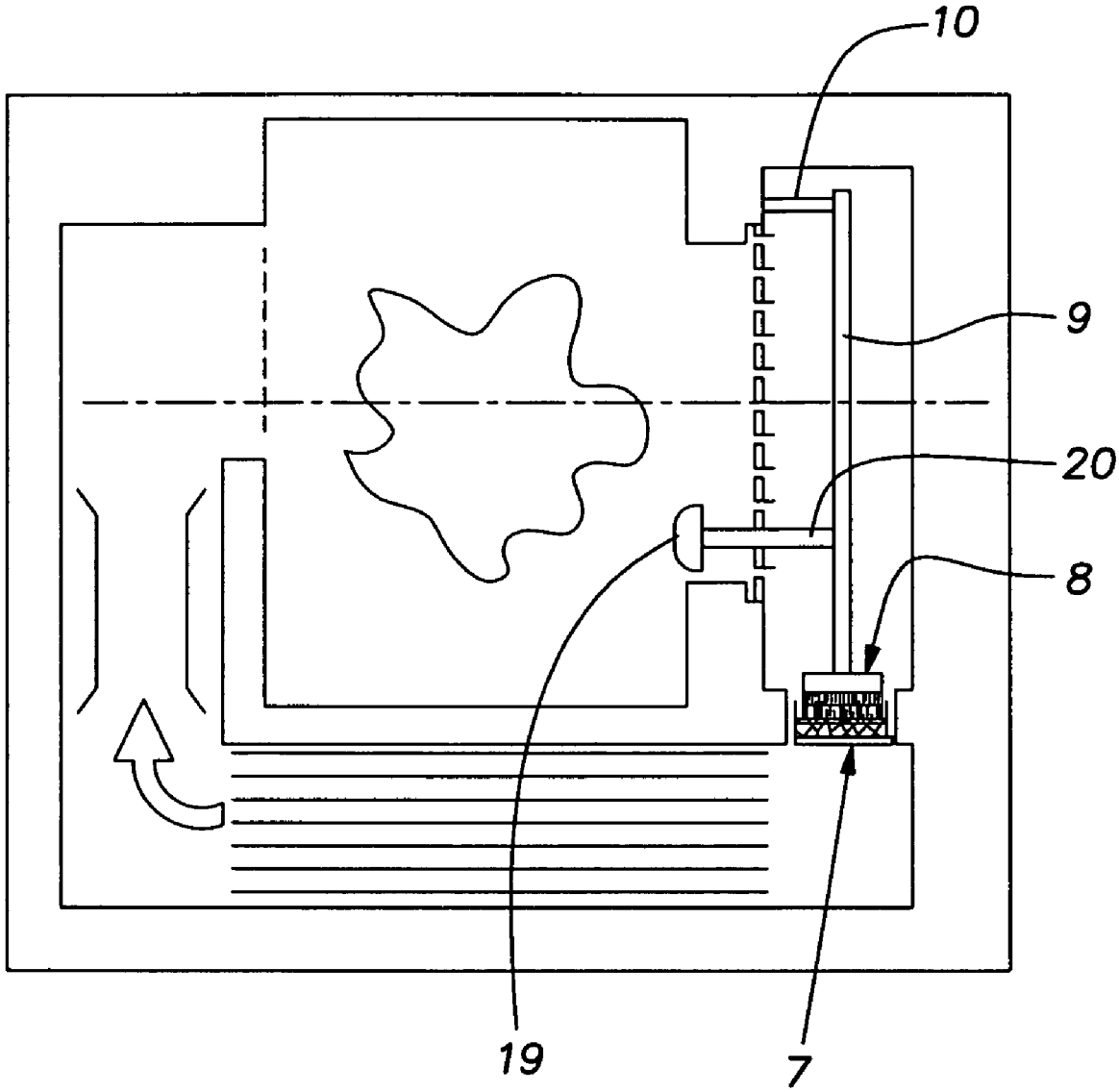
FIG. 10 is a median cross-sectional view of a clothes drying machine provided with the device shown in FIG. 9.

Therefore, with particular reference to FIGS. 9 and 10, a simplified embodiment shall be discussed next. As in the above-described case, use is made again of the moving arm 9 and the rotation pin 10; the latter, however, is in this case driven by a second driving member 19, which is introduced in the lower portion of the drum and is firmly joined with said brush, or with said moving arm, via a drive shaft 20.

This drive shaft 20 is allowed to pass through said stationary wall 5 by providing the latter with a slot-like aperture 21 in the shape of an arc of a circle; in this way, said driving member 19 is caused to perform a back-and-forth movement by the peripheral portion of the clothes moving around in the drum, so that it in turn drives said shaft 20 that again drives the moving arm 9 into a rotary motion about the rotation pin 10 and, ultimately, the brush attached to the free end of said moving arm is forced to displace, thereby performing the desired wiping movement to clean the filter.

It may at this point be appropriate to point out that, in this case, the drive shaft 20 is not coaxial with the axis of the drum, but is on the contrary appreciably offset from this axis, albeit parallel thereto. In this way, it is actually driven by the sole peripheral movement of the drying load in the drum and, therefore, when this shaft eventually reaches the end of its displacement, as determined by the end of the slot, it stops even if the drum keeps rotating, until the direction of rotation of the same drum is eventually reversed. At this point, said shaft is pushed in the opposite direction, and hence it causes said brush to act again on said filter, until the same shaft comes again to stop by abutting against the other end-of-displacement represented by the opposite end of the slot.

This process occurs iteratively each time that the direction of rotation of the drum is reversed and, therefore, even the filter is cleaned only once at each reversal of said direction of rotation.

The invention claimed is:

1. Clothes drying machine comprising:

a rotating drum (1) holding the clothes to be dried, an outlet mouth (4), from which the drying air is released after having flown through said drum, an exhaust conduit (2), into which flows the air issuing from said outlet mouth (4), a lint filter (7), formed substantially in the shape of a sector of a cylindrical surface, which is arranged in said exhaust conduit below said outlet mouth (4) of the drum, with the axis (X) thereof extending substantially parallel to the axis of rotation of the drum and fixed to a machine frame, a stationary wall (5), which is at least partially applied on to said outlet mouth (4) and is provided with a plurality of perforations (6) for the air leaving said drum and entering said exhaust conduit (2) to pass therethrough, and automatic means for cleaning of said filter (7), or a part thereof, through a brushing action, said automatic means comprising:

a brush (8) connected to an end portion of a moving arm (9), which is hinged, on the other end portion thereof opposite to said brush, on to a rotation pin (10), said moving arm being slidably linked with a driving pin (15), which is adapted to rotate, by means of a respective rotation arm (13), about a driving spindle (12), and said driving spindle (12) being driven rotatably about its own axis by automatic driving devices, wherein said brush is adapted to cover, and wipe, the surface of said filter with a continuous reciprocating motion, or an intermittent reciprocating motion, when said moving arm (9) rotates about said rotation pin (10).

2. Clothes drying machine according to claim 1, wherein said automatic means further comprises:

a second driving member (19) adapted to be inserted inside said drum and connected via a drive shaft (20) to said moving arm (9), preferably at the end portion thereof supporting said brush (8).

3. Clothes drying machine comprising:

a rotating drum (1) holding the clothes to be dried, an outlet mouth (4), from which the drying air is released after having flown through said drum, an exhaust conduit (2), into which flows the air issuing from said outlet mouth (4), a lint filter (7), formed substantially in the shape of a sector of a cylindrical surface, which is arranged in said exhaust conduit below said outlet mouth (4) of the drum, with the axis (X) thereof extending substantially parallel to the axis of rotation of the drum, a stationary wall (5), which is at least partially applied on to said outlet mouth (4) and is provided with a plurality of perforations (6) for the air leaving said drum and entering said exhaust conduit (2) to pass therethrough, and automatic means for cleaning of said filter (7), or a part thereof, through a brushing action, said automatic means comprising:

a brush (8) connected to an end portion of a moving arm (9), which is hinged, on the other end portion thereof opposite to said brush, on to a rotation pin (10), said moving arm being slidably linked with a driving pin (15), which is adapted to rotate, by means of a respective rotation arm (13), about a driving spindle (12), and said driving spindle (12) being driven rotatably about its own axis by automatic driving devices, wherein said automatic driving devices comprise a first driving member (17), which is arranged inside said drum, connected to said driving spindle (12) via an appropriate connecting rod (18), and adapted to be driven rotatably about the same connecting rod (18) by the turning movement of the drying load inside the drum.

4. Clothes drying machine according to claim or 3, wherein said moving arm (9), said driving spindle (12) and said first driving member (17) are hinged on to and supported by said stationary wall (5).

5. Clothes drying machine comprising:

a rotating drum (1) holding the clothes to be dried, an outlet mouth (4), from which the drying air is released after having flown through said drum, an exhaust conduit (2), into which flows the air issuing from said outlet mouth (4), a lint filter (7), formed substantially in the shape of a sector of a cylindrical surface, which is arranged in said exhaust conduit below said outlet mouth (4) of the drum, with the axis (X) thereof extending substantially parallel to the axis of rotation of the drum, a stationary wall (5), which is at least partially applied on to said outlet mouth (4) and is provided with a plurality of perforations (6) for the air leaving said drum and entering said exhaust conduit (2) to pass therethrough, and automatic means for cleaning of said filter (7), or a part thereof, through a brushing action, wherein said automatic means further comprises a second driving member a brush (8) connected to an end portion of a moving arm (9), which is hinged, on the other end portion thereof opposite to said brush, on to a rotation pin (10), (19) adapted to be inserted inside said drum and connected via a drive shaft (20) to said moving arm (9), at the end portion thereof supporting said brush (8), and wherein said stationary wall (5) is provided with a slot-like aperture (21) adapted to enable said second driving member (19) to pass through said stationary wall during the rotary movement of said moving arm (9) about said rotation pin.

6. Clothes drying machine according to claim 5, wherein said moving arm (9) is hinged on to and supported by said stationary wall (5).

* * * * *